US012692747B2

(12) United States Patent
Comacchio et al.

(10) Patent No.: US 12,692,747 B2
(45) Date of Patent: Jul. 28, 2026

(54) SPINDLE FOR DRILLING HEAD

(71) Applicant: Comacchio SpA, Riese Pio X (IT)

(72) Inventors: Pasqualino Comacchio, Riese Pio X (IT); Patrizio Comacchio, Riese Pio X (IT); Renzo Comacchio, Riese Pio X (IT)

( * ) Notice: Subject to any disclaimer, the term of this patent is extended or adjusted under 35 U.S.C. 154(b) by 0 days.

(21) Appl. No.: 19/154,317

(22) PCT Filed: Mar. 13, 2024

(86) PCT No.: PCT/IB2024/052416

§ 371 (c)(1),
(2) Date: Aug. 6, 2025

(87) PCT Pub. No.: WO2024/189552

PCT Pub. Date: Sep. 19, 2024

(65) Prior Publication Data

US 2026/0110218 A1 Apr. 23, 2026

(30) Foreign Application Priority Data

Mar. 16, 2023 (IT) ..... 102023000005037
Mar. 12, 2024 (IT) ..... 102024000005494

(51) Int. Cl.
*E21B 3/02* (2006.01)
*E21B 19/07* (2006.01)
*E21B 33/04* (2006.01)

(52) U.S. Cl.
CPC ..... *E21B 3/02* (2013.01); *E21B 19/07* (2013.01); *E21B 33/04* (2013.01)

(58) Field of Classification Search
CPC ..... E21B 3/02; E21B 19/07; E21B 33/04
See application file for complete search history.

(56) References Cited

U.S. PATENT DOCUMENTS 2,853,282 A * 9/1958 Meredith, Jr. ..... E21B 33/0422 254/31
3,090,640 A * 5/1963 Otteman ..... E21B 33/043 285/123.8
3,334,924 A * 8/1967 Todd ..... E21B 33/043 166/348
3,711,123 A * 1/1973 Arnold ..... F16L 7/02 285/123.6
3,748,702 A * 7/1973 Brown ..... E21B 19/10 188/67

(Continued)

FOREIGN PATENT DOCUMENTS

CN 114059943 2/2022
SU 515871 5/1976

*Primary Examiner* — Neel Girish Patel
(74) *Attorney, Agent, or Firm* — Themis Law

(57) ABSTRACT

A spindle for drilling heads has a substantially tubular or annular shape, with a clearance that is arranged so that it is coaxial with a drilling axis, and includes a gripping member or jaws configured to grip a drilling rod, and an actuator for selectively opening or closing the gripping member or jaws and rotating around the drilling axis integrally with the gripping member or jaws. The spindle also includes a revolving joint, through which the fluid that activates the actuator flows, and which is mounted on a free end of the spindle, on the end that is not directly constrained to the drilling head.

9 Claims, 7 Drawing Sheets

(56) References Cited

U.S. PATENT DOCUMENTS

| | | | | | |
|---|---|---|---|---|---|
| 4,589,802 | A * | 5/1986 | Hampton | E21B 41/08 | 405/227 |
| 4,593,769 | A | 6/1986 | Armstrong | | |
| 4,754,820 | A * | 7/1988 | Watts | E21B 33/085 | 285/912 |
| 5,158,326 | A * | 10/1992 | Anderson | F16L 17/10 | 285/123.9 |
| 5,522,464 | A * | 6/1996 | Piper | E21B 33/0422 | 166/212 |
| 7,455,105 | B1 * | 11/2008 | McKee | E21B 17/20 | 166/77.2 |
| 2005/0000691 | A1 * | 1/2005 | Giroux | E21B 21/00 | 166/291 |
| 2005/0067168 | A1 * | 3/2005 | Baird | E21B 3/04 | 166/380 |
| 2015/0275592 | A1 * | 10/2015 | Wood | E21B 19/07 | 166/380 |
| 2016/0177652 | A1 * | 6/2016 | Thornburrow | E21B 33/04 | 166/85.1 |
| 2017/0175463 | A1 * | 6/2017 | Ritter | E21B 19/10 | |

* cited by examiner

SPINDLE FOR DRILLING HEAD

The present patent concerns machines for drilling and/or treating soil, and in particular it concerns a new spindle for drilling heads.

Drilling rigs are known, which are equipped with a drilling mast on which the drilling head, that is, the member suited to rotate/translate the sets of drilling rods, slides.

Drilling heads are known, in which there is a clearance for the passage of the drilling rod through the head, the diameter of said clearance being at least sufficient for the passage of the rod.

Under the drilling head, that is, the drive member that makes the set of drilling rods rotate, there is a rod gripping spindle for specific machining operations, which is mechanically connected to the head in such a way as to transmit the rotary motion to the rod when the spindle is closed and grips the rod.

The spindles of the known type comprise:

- a rotating part, mechanically connected to the rotary member of the drilling head and thus intended to rotate axially with the output mechanism of the drilling head;
- a non-rotating part, which is thus intended to remain integral with the non-rotating parts of the drilling head.

Said rotating part in turn comprises:

- a flange for mechanical connection with the drilling head;
- one or more jaws with gripping inserts suited to close radially towards the drilling axis in order to grip the drilling rod.

Said non-rotating part comprises:

- actuators suited to cause the jaws to selectively open and close, wherein said actuators are normally of the fluid-dynamic type and more preferably of the hydraulic type;
- supply means for the hydraulic circuit of the actuators.

Between said non-rotating part and said rotating part there is a set of bearings, which can be of various types.

However, said bearings are subject to high stress, particularly during rotation and when the spindle is closed, that is, with the jaws gripping the drilling rod, due to the fluid pressure in the hydraulic circuit that activates the closing actuators. Therefore, these components are subject to wear and require frequent maintenance and replacement operations.

In this regard, see the detailed description of the figures showing spindles of the currently known type.

Document CN 114 059 943 A describes a spindle comprising a fluid-dynamic actuator which rotates together with the clamping jaws, wherein the fluid distribution system is obtained in an annular body which is integral with the actuator and adjacent to the drilling rod. Said annular body is equipped with a locking valve which is integrated inside it and through which the fluid is injected in one of the chambers of the actuator in order to cause the jaws to open/close. In this type of spindle there are no bearings between the rotating parts, and instead the fluid is made leak therebetween, thus using it also as a lubricant. In case of malfunction of the spindle, which for example and very frequently occurs due to the friction between the moving parts and due to the impurities possibly present in the fluid, it is not possible to perform maintenance operations or to replace worn parts without completely disassembling the entire spindle. More specifically, the valve and the annular body, which are more prone to said malfunctions, are completely inaccessible from the outside of the spindle and furthermore they constitute the entire body of the spindle itself.

The subject of the present patent is a new spindle for drilling heads, designed to grip drilling rods, wherein even the actuators that open/close the jaws rotate with respect to the drilling axis, integrally with the jaws themselves.

The main object of the present invention is to develop a new hydraulic spindle without a set of bearings on the rotating gripping part, in order to eliminate the problems related to the wear of the bearing pack and to the consequent breakages and machine downtime.

Another object of the present invention is to integrate the locking valve and the fluid distribution system in a compact part which can be easily accessed from the outside and disassembled for any maintenance or replacement operations.

Another object of the present invention is to guarantee the tightness of the spindle in the closed position even in case of undesired fluid leakages from the actuators, thanks to integrated accumulators which guarantee that the clamping pressure is kept unchanged, as described and claimed further on in this description.

These and other direct and complementary objects are achieved by the new spindle, which is substantially tubular or annular in shape, that is, has a clearance configured in such a way that it is coaxial with the drilling axis.

In its main parts, said spindle comprises:

- a rotating part, intended to be mechanically connected to the rotating components of the drilling head and thus to rotate axially around the drilling axis;
- a non-rotating part.

Said rotating part in turn comprises:

- one or more jaws or means suited to grip a rod, said jaws comprising movable elements or inserts designed to selectively close/open with respect to the drilling axis;
- at least one actuator of the fluid-dynamic type for selectively opening/closing said jaws,
- and wherein said at least one actuator rotates integrally with said jaws.

The non-rotating part, hereinafter referred to as the collar, comprises supply points for the fluid-dynamic circuit of the actuator.

Said collar is part of an assembly, hereinafter referred to as the revolving joint, which comprises a rotary annular body, integral with said rotating part, and said collar mounted on said rotary annular body by means of gaskets and mechanical elements that allow the idle rotation of said rotating part of the spindle with respect to said collar, while at the same time ensuring the supply of activation fluid to the actuators. Said revolving joint is in fluid communication with said actuator by means of at least one hydraulic circuit feeding the actuator and at least one locking valve, conveniently configured and also intended to rotate integrally with said actuators.

The new spindle works as follows.

In the open position, meaning when said one or more jaws are open, the actuators are in the resting position and the hydraulic circuit of the actuators is not under pressure; the supply line upstream of the locking valve is not under pressure, as the mobile element of the supply line distribution valve is of the type with "open centre"; therefore, in the joint there is no pressure and consequently the gaskets do not exert any loading action on the rotating part.

To close the jaws, as this operation is usually but not necessarily performed with non-rotating spindle, the fluid is injected through said revolving joint and said hydraulic circuit, opening the valve and activating the actuators which, in turn, cause the jaws to clamp the drilling rod. Once a certain first pressure value has been reached in the hydraulic circuit of the actuators, the spindle clamping operation is stopped and said locking valve closes automatically, maintaining the pressure on the actuators and thus the clamping pressure on the jaws unchanged.

In this situation, the rotary motion of the drilling head is transmitted to the jaws and thus to the drilling rod.

In this condition, the clamping operation having been completed, the pressure in the circuit upstream of the locking valve is released, again thanks to the fact that the mobile element of the supply line distribution valve is of the type with "open centre". As a result, in the revolving joint there is no pressure and consequently the gaskets do not exert any loading action on the rotating part.

According to the invention, the new spindle also comprises at least one fluid accumulator which is connected to said at least one actuator and suited to maintain the clamping pressure inside the actuator unchanged, even in case of undesired fluid leakages from said at least one actuator.

To reopen the jaws, said actuators need to be retracted by means of a special circuit, according to the type of actuator, which can be single-acting or double-acting, for example.

As a result, the locking valve is released, thus emptying said actuators of the fluid that causes the spindle to clamp the drilling rod.

For this purpose, according to the invention, said revolving joint comprises a second clearance to enable this function. By way of example, if said at least one actuator is of the single-acting type, it will be sufficient to open said locking valve to cause the actuator to return to the retracted position thanks to the action of elastic means, for example. Conversely, in the case of a double-acting actuator, the fluid will be injected into a first chamber of the actuator to cause its extension and into a second chamber of the actuator to cause its retraction.

Said revolving joint, which comprises said fixed collar and said rotary annular body, is a compact unit, mounted on the free end of the spindle and not inside it, in such a way that it can be easily disassembled to carry out maintenance/replacement operations.

Analogously, said locking valve is mounted on the spindle in an external position with respect to said at least one actuator, and is preferably connected to said annular body of the revolving joint by means of ducts which can be accessed from the outside of the spindle, without requiring the removal of other parts of the spindle itself.

The characteristics of the new spindle are better clarified in the following description, making reference to the drawings, which are attached by way of non-limiting example. For a better description of the spindles of the known type, refer to the attached FIGS. 1 and 2, which show a sectional view of a spindle (100) with open and closed jaws, respectively.

The spindle (100) comprises a rotating part (110), that is, a part intended to rotate with respect to the drilling axis (X) and coaxial with the drilling rod (A), and a non-rotating part (120), highlighted with a thicker hatching.

Between the rotating part (110) and the non-rotating part (120) there are several bearings (130).

Said rotating part (110) comprises a flange or mechanical fixing or connection means (111) for mechanical connection with the rotating components of the drilling head (10), as shown in FIG. 1*a*.

Said rotating part (110) comprises one or more gripping members or jaws (112) suited to grip the drilling rod (A). Said jaws (112) comprise, for example, inserts (113) arranged circumferentially around the drilling axis (X) and suited to move orthogonally to the axis (X) to open or close on the rod (A).

For this purpose, said inserts (113) comprise, for example, an inclined part (114) with wedges (115) sliding axially thereon, wherein at least one actuator (121) acts on said wedges (115). In the example shown in FIGS. 1 and 2, said actuator (121) is an annular cylinder, comprising a fixed part (122) and an axially translating part (123), and wherein between said fixed part (122) and said translating part (123) a chamber (124) is defined, into which the hydraulic fluid is injected through at least one supply point (125).

The injection of pressurized fluid into said chamber (124) causes the actuator (121) to extend, meaning that it causes the axial translation of said translating part (123), which pushes said wedges (115), causing the inserts (113) to close and thus grip the rod (A). Conversely, discharging the fluid from the chamber (124) makes the actuator retract, causing the jaws (112), that is, the inserts (113) to reopen.

In this type of spindle, therefore, the fluid supply and distribution system as well as the actuators are located in the non-rotating part of the spindle.

When the spindle is closed on the rod and during the rotation of the latter, the stress between the rotating part and the non-rotating part is very high, as the actuators (121) act on the wedges (115) with the clamping pressure. For this reason, it is necessary to introduce elements subject to wear and to provide for several maintenance operations. In the example of FIGS. 3 and 4, showing a sectional view of a second spindle (100') of the known type in the open and closed position, respectively, it can be observed that in this case the non-rotating part (120') of the spindle (100') comprises hydraulic jacks (126), for example three or more, according to the pressure to be exerted. In the example shown, each jack (126) is independent of the others.

Also in this case, the extension/retraction of the jacks (126) in the axial direction causes the axial displacement of the wedges (115) and the closing/opening of the jaws (112), that is, of said inserts (113).

Even in this case it is possible to observe the same drawbacks mentioned above. FIGS. 5 and 6 show a sectional view of the spindle (200) that is the subject of the present patent in the open and closed configuration, respectively. In these figures the rotating part is highlighted with a thinner hatching, while the non-rotating part is highlighted with a thicker hatching.

The new spindle (200) comprises a rotating part (210), which is intended to be mechanically connected to the rotating components of the drilling head and thus to rotate axially around the drilling axis (X), coaxially with the drilling rod (A).

Said rotating part (210) comprises a flange (211) for mechanical connection with the rotating components of the drilling head (10), as shown in FIG. 5*a*.

Said rotating part (210) comprises one or more gripping members or jaws (220) suited to grip the drilling rod (A). Said jaws (220) comprise, for example, inserts (221) arranged circumferentially around the drilling axis (X) and suited to move away from and towards the axis (X), for example orthogonally, to open or close on the rod (A). For this purpose, said inserts (221) comprise, for example, an inclined part (222) with wedges (230) sliding axially thereon. At least one actuator (240) acts on said wedges (230).

Said at least one actuator (240) belongs to said rotating part (210), meaning that it is intended to rotate axially and integrally with said jaws (220).

Said at least one actuator (240) comprises at least one extendable annular cylinder or two or more independent hydraulic jacks distributed circumferentially around said drilling axis (X) or another device suited to be extended in the axial direction, that is, parallel to said drilling axis (X).

Figure 1:
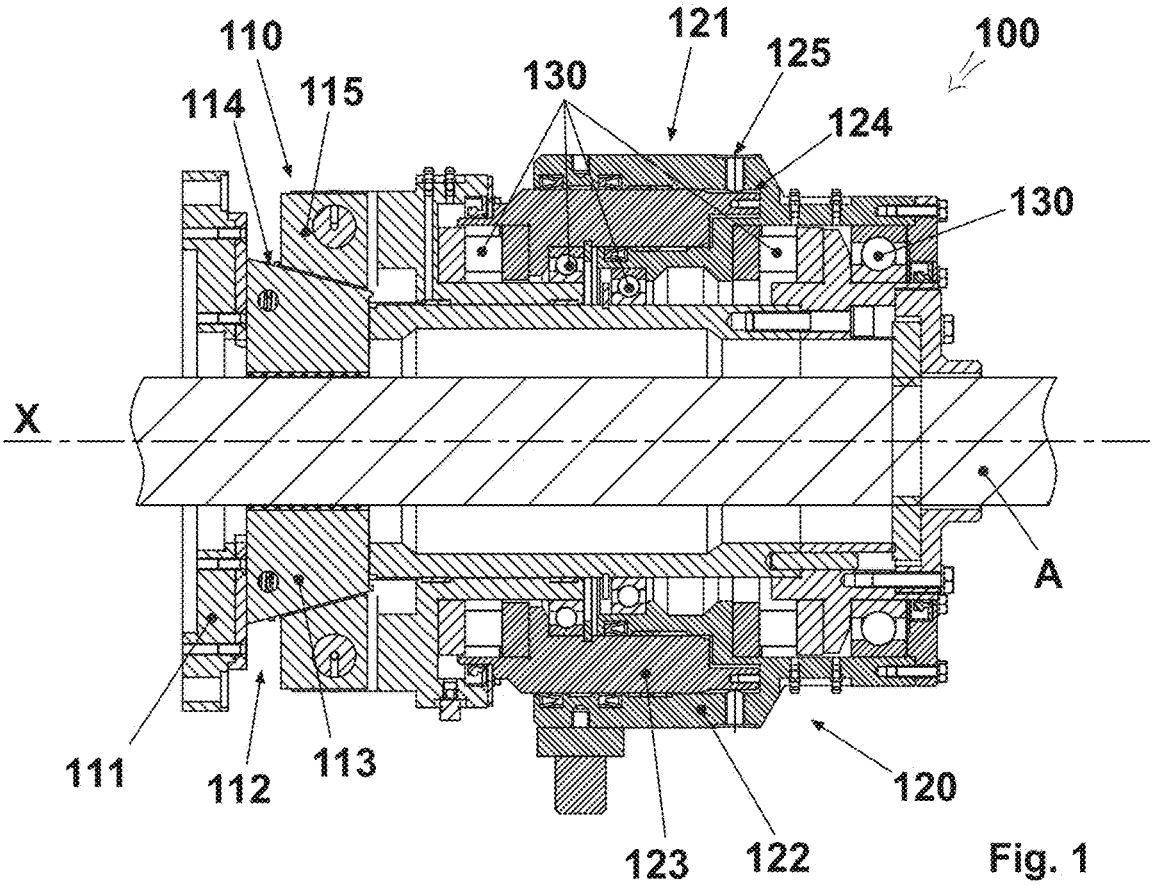
Fig. 1 (Prior Art)
Figure 2:
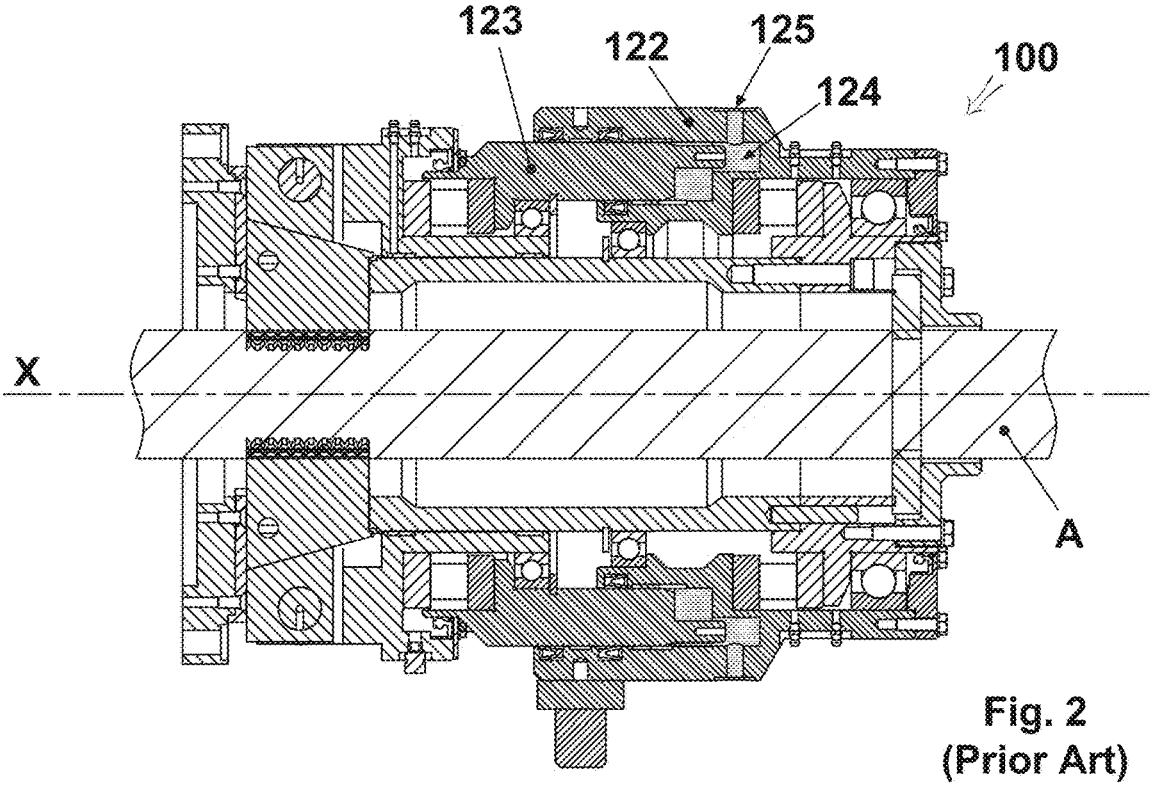
Fig. 2 (Prior Art)
Figure 1A:
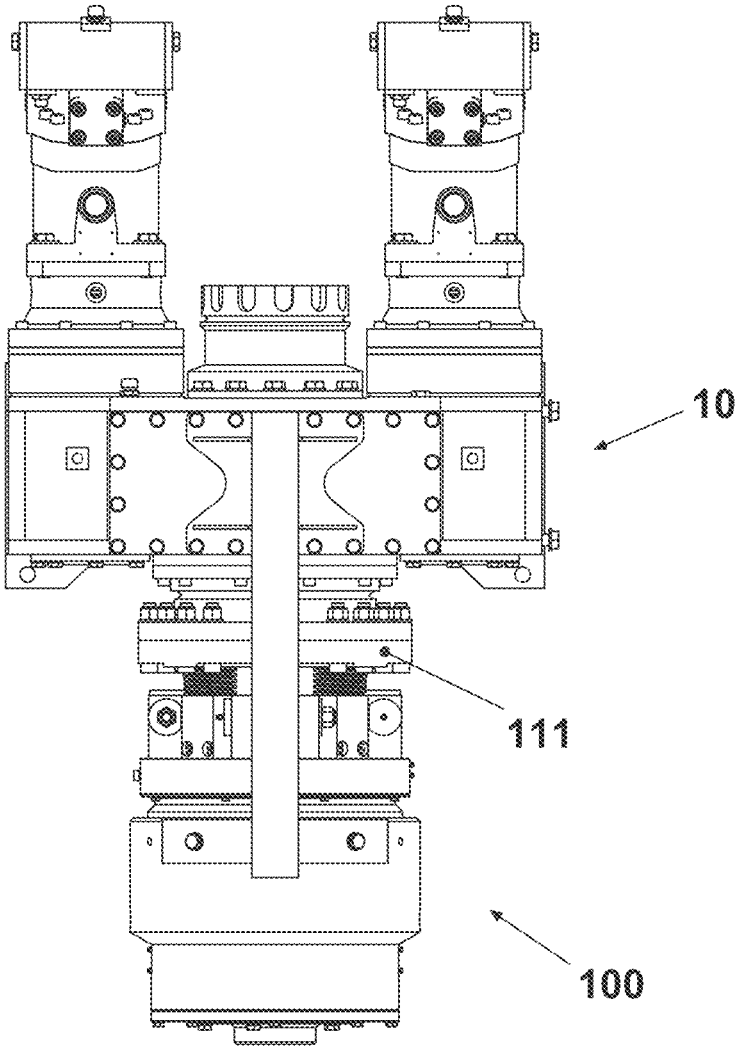
Fig. 1a (Prior Art)
Figure 3:
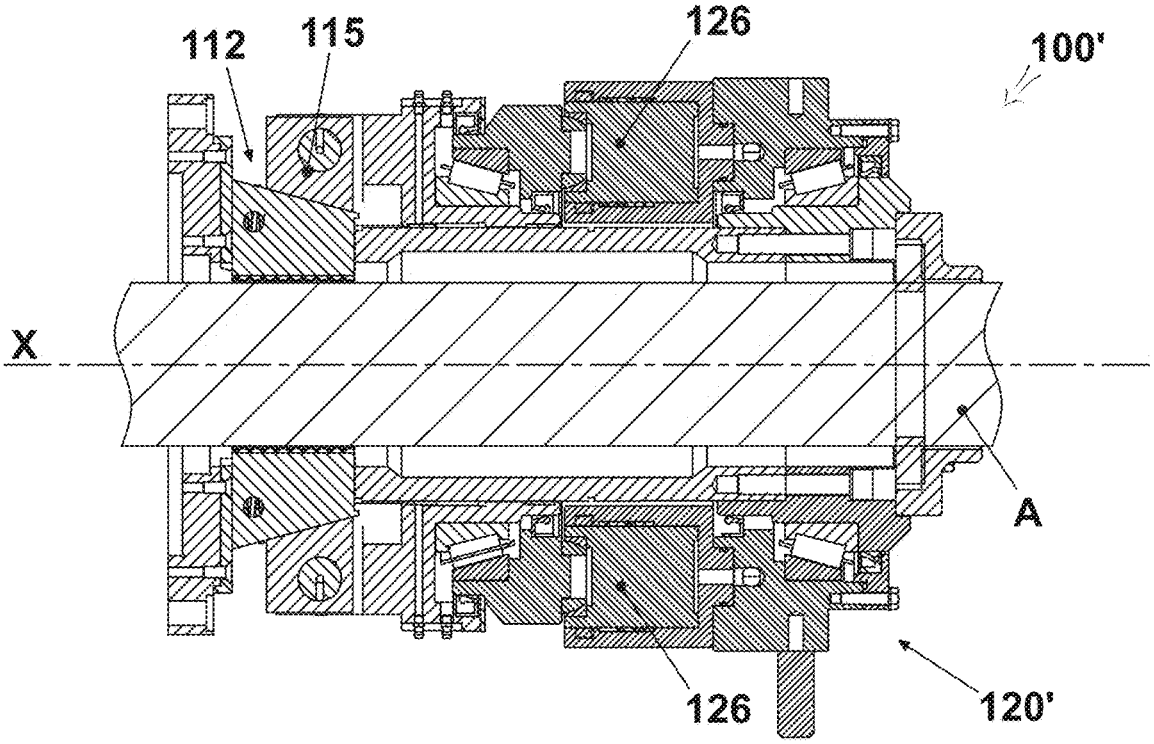
Fig. 3 (Prior Art)
Figure 4:
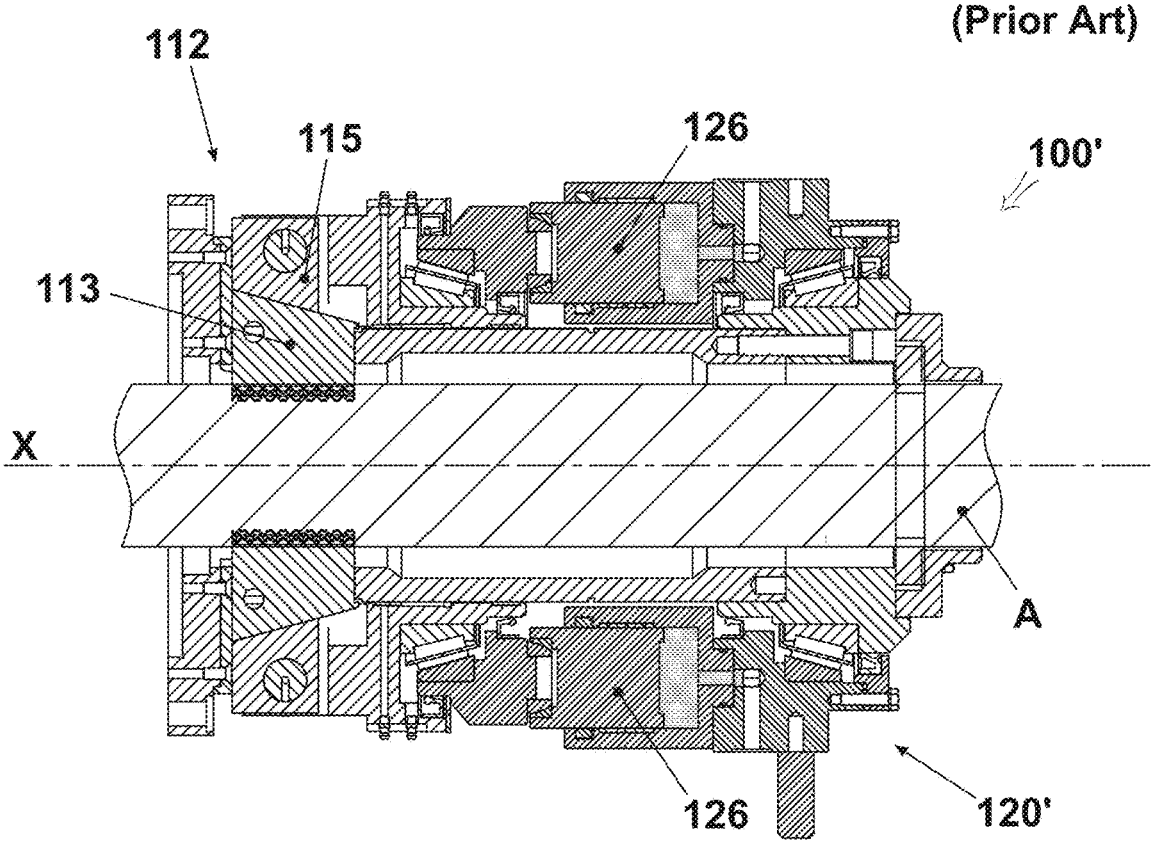
Fig. 4 (Prior Art)

Said rotating part (210) comprises also the hydraulic circuit (250) of the at least one actuator (240), which is therefore also intended to rotate integrally with said at least one actuator (240) and with said jaws (220).

Said hydraulic circuit (250) comprises means or ducts (251, 252) for supplying fluid into the chamber (241) of the at least one actuator (240) and at least one locking valve (260).

The new spindle (200) comprises also a revolving joint (270), in turn comprising:

- a non-rotating part or collar (275), substantially annular or cylindrical in shape, which is coaxial with the axis (X) and constrained through connection means (271) in such a way that it cannot rotate axially; said collar (275) is provided with the fluid supply/outlet points;
- an annular element (280), coaxial with the axis (X), which rotates integrally with said rotating part (210) and contains all the channels suited to ensure hydraulic communication with said hydraulic circuit (250).

Said collar (275) and said annular element (280) are mounted coaxially one into the other and said annular element (280) can rotate axially within said collar (275).

The fluid that activates said at least one actuator (240) thus flows through the revolving joint (270), and more precisely through said non-rotating collar (275) and said rotary annular element (280).

Mechanical elements (290) are provided between said collar (275) and said rotary annular element (280) of said revolving joint (270) to allow the rotation of said rotating part (210) of the spindle (200) with respect to said collar (275).

Said mechanical elements (290), which actually are not subjected to the load to which the bearings (130) of the known spindles (100, 100') are normally subjected, can be normal bearings, or bushings or other mechanical elements having the same function. Thus, said mechanical elements (290) are even less subject to wear than the bearings used in the spindles of the known type. In any case, any maintenance operation can be easily carried out thanks to the special configuration of the revolving joint (270), which is compact and mounted on the free end of the spindle (200), that is, on the end of the spindle (200) that is not constrained to the drilling head (10).

Said revolving joint (270) comprises at least one first supply point (272) for conveying fluid into a first delivery duct (251) of the hydraulic circuit (250) of the at least one actuator (240).

Said revolving joint (270) also comprises at least one second supply point (273) for conveying fluid into a second delivery duct (252) of the hydraulic circuit (250).

Said delivery ducts (251, 252) convey the fluid to said locking valve (260).

Figure 5:
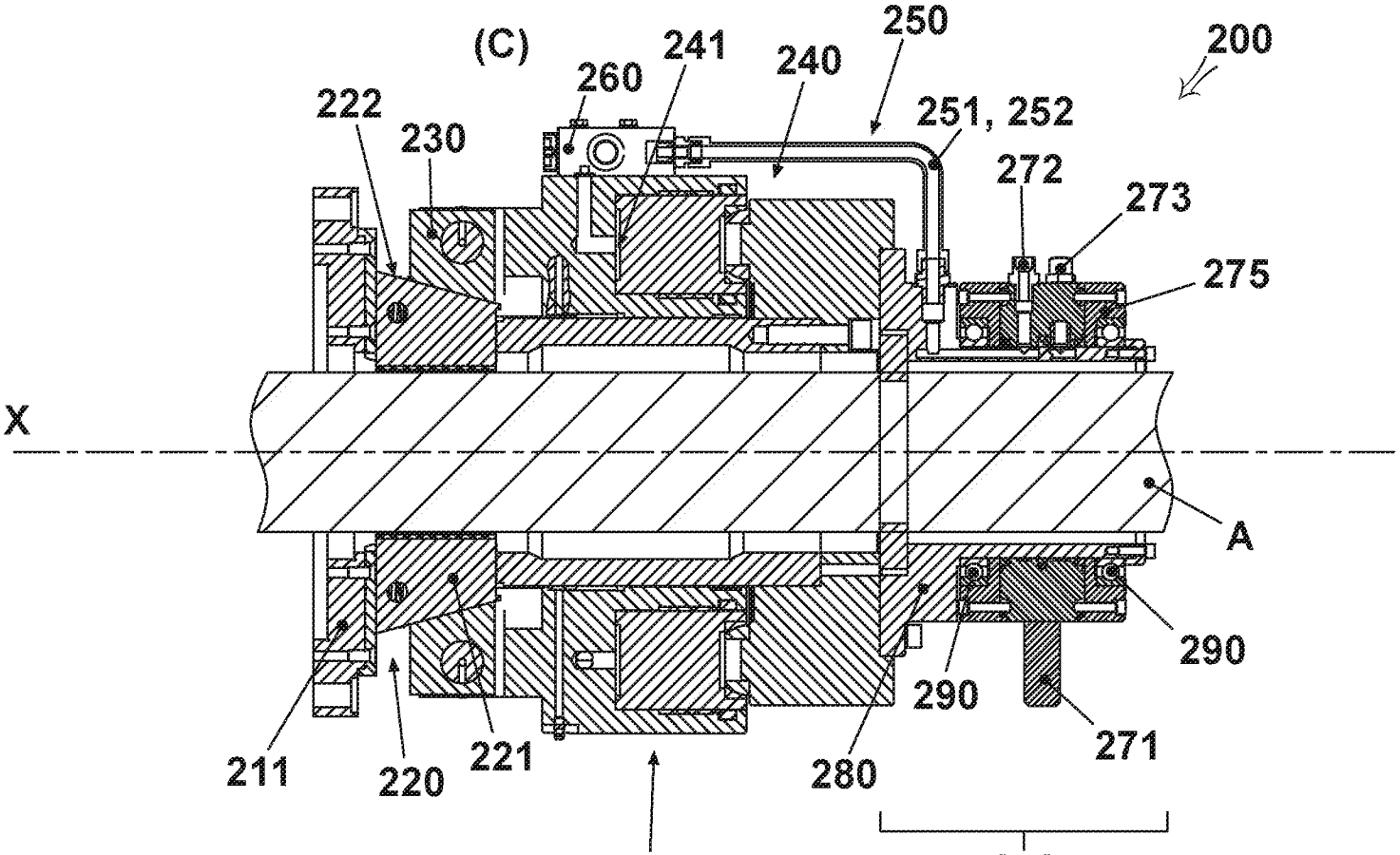
FIG. 5 shows the actuator (240) in the retracted configuration (C), in which said wedges (230) are positioned backward, in the resting position, and said jaws (220) are open.
Figure 6:
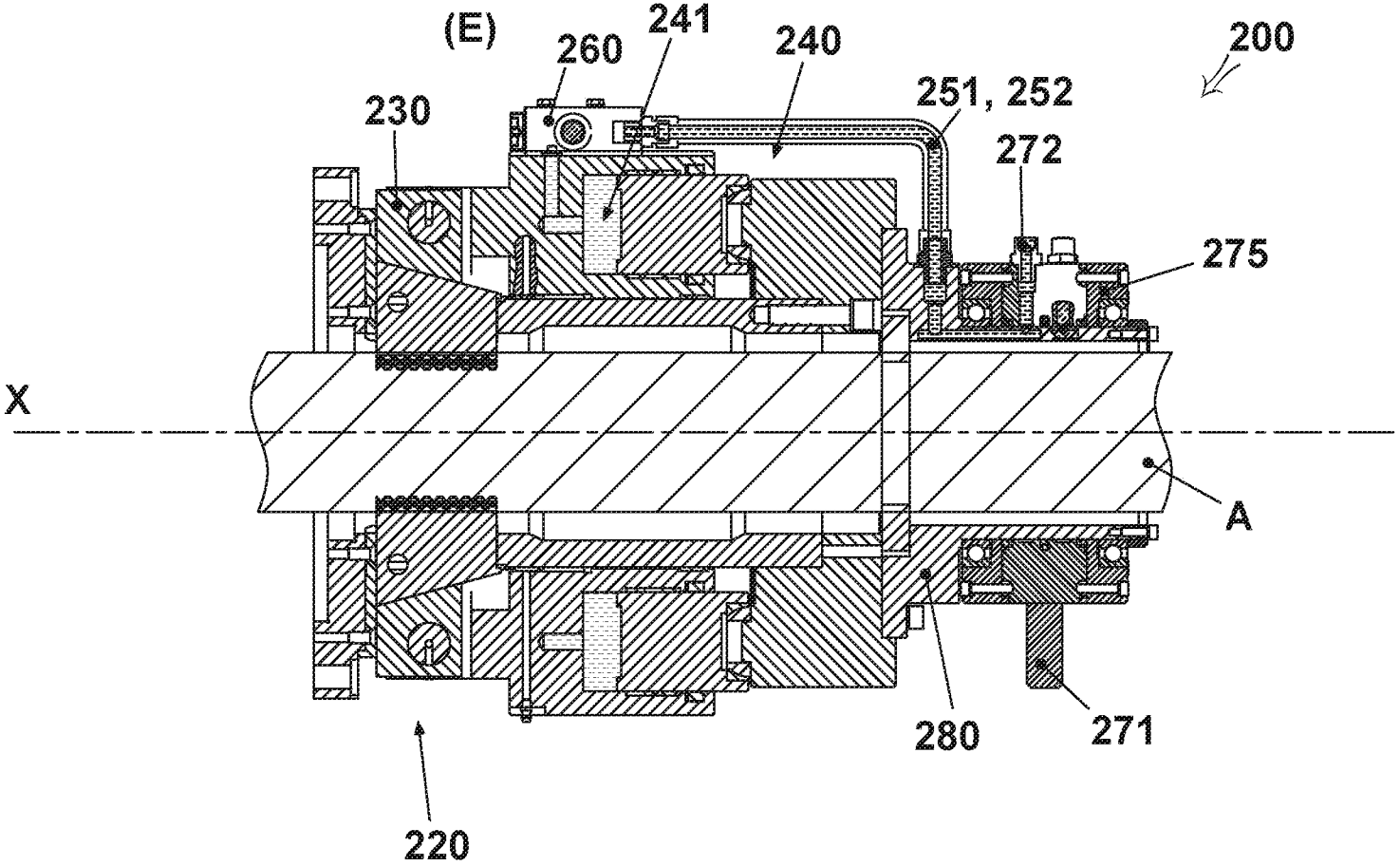
FIG. 6 shows the actuator (240) in the extended configuration (E), in which said wedges (230) are positioned forward, in the operating position, and said jaws (220) are closed on said drilling rod (A).

In the configuration with open jaws (220), shown in FIG. 5, the circuit upstream of the locking valve (260) is not under pressure, as the mobile element of the fluid supply line distribution valve, not shown in the figures because it is not part of the present patent, is of the type with "open centre".

In order to close the jaws (220), the fluid is injected through said first supply point (272) of the revolving joint (270) and said first delivery duct (251), causing the locking valve (260) to open and the actuator (240) to extend at the same time.

The extension of the actuator (240) causes the axial displacement of the wedges (230) and the clamping of the jaws (220), that is, the radial displacement of the inserts (221) that grip the rod (A).

Once the spindle clamping step has been completed and a certain clamping pressure has thus been reached, said locking valve (260) closes, thus maintaining the pressure inside the at least one actuator (240) and consequently also the clamping force on the jaws (220) unchanged. As a result, the pressure is released from the circuit upstream of the valve (260), as the mobile element of the distribution valve is of the type with "open centre".

To reopen the jaws (220), said at least one actuator (240) needs to be retracted by means of a special circuit, according to the type of actuator, which can be single-acting or double-acting, for example. Consequently, the locking valve (260) is released, emptying the actuators of the fluid and thus causing the spindle to open.

Figure 8:
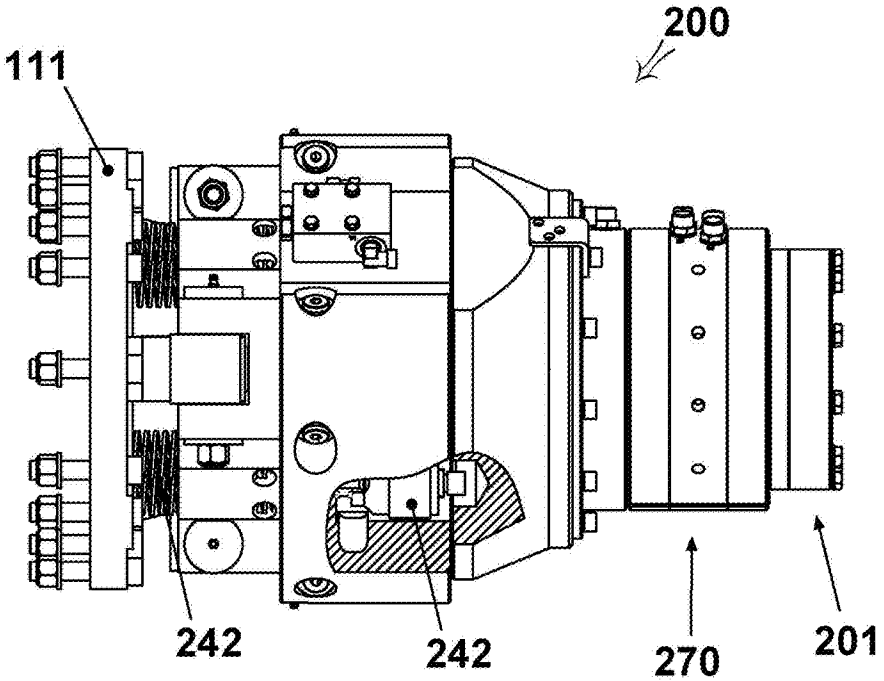
Figure 7:
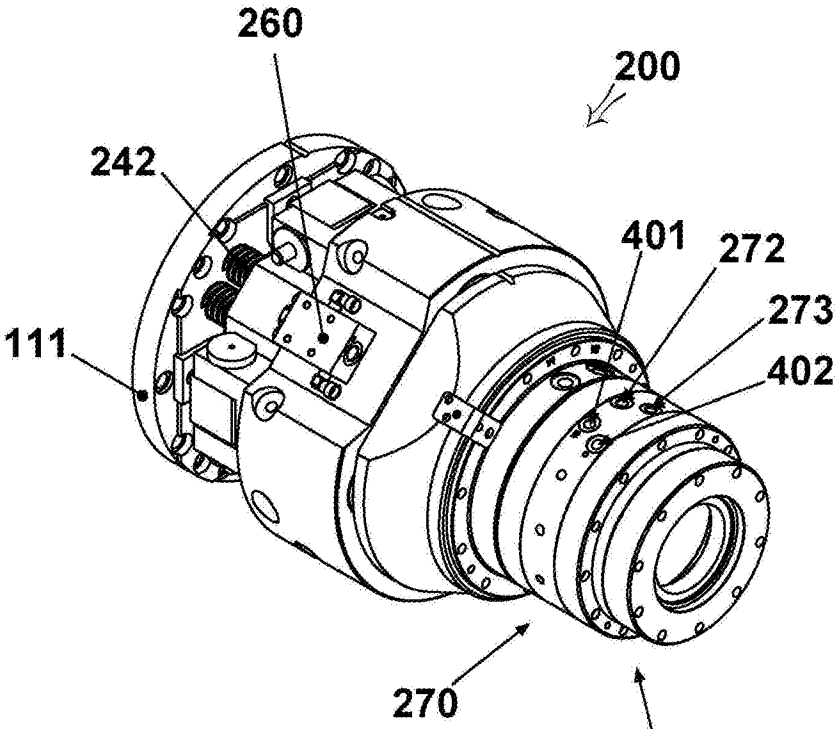
Figure 9:
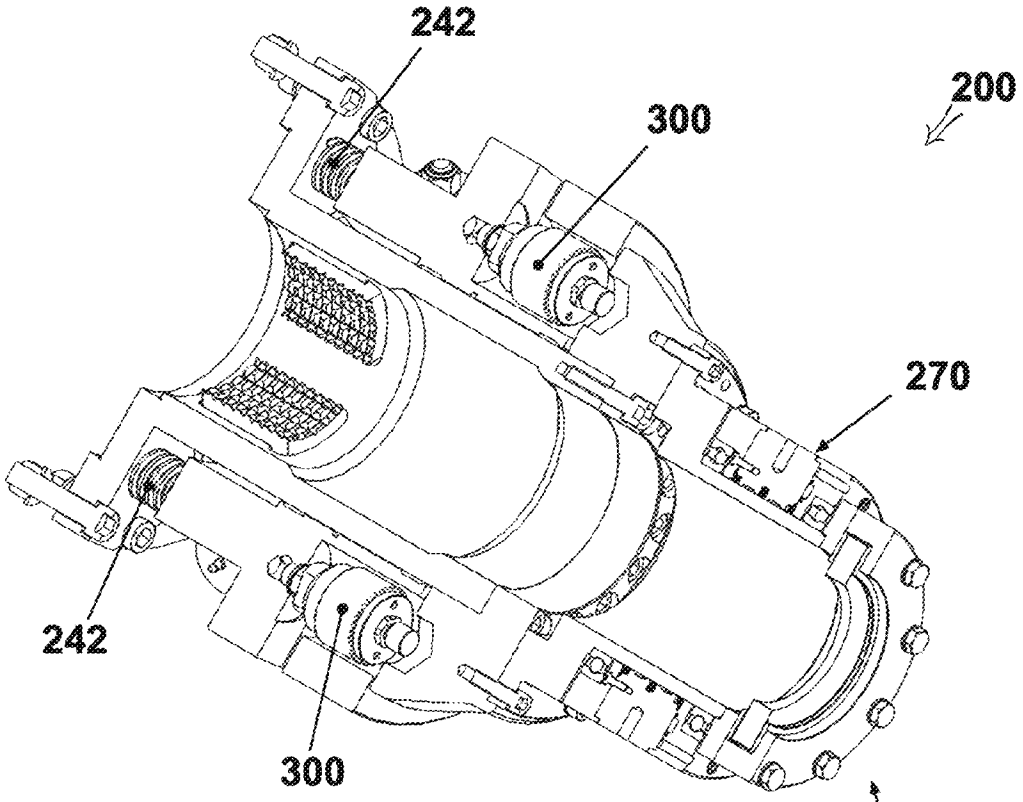

The fluid is injected through said second supply point (273) of the revolving joint (270) and said second delivery duct (252), causing the valve (260) to reopen and the at least one actuator (240) to retract if, for example, the latter is of the double-acting type; in the case of a single-acting actuator, instead, its retraction is obtained through elastic means (242), visible for example in FIGS. 7, 8 and 9. Consequently, the fluid contained in said at least one actuator (240) is discharged.

The actuator (240) then retracts, causing the wedges (230) to return to their backward position and the jaws (220) to reopen.

Said revolving joint (270) preferably comprises also a cooling circuit, not shown in the figures, comprising a channel which is obtained within said collar (275) and in which a fluid suited to cool the rotating parts and said mechanical elements (290) circulates.

In a preferred solution, said cooling circuit comprises inlet and outlet holes (401, 402) made in said revolving joint (270) and shown, for example, in FIG. 7.

FIG. 7 shows a three-dimensional view of the new spindle (200), where it is possible to observe its special and innovative configuration. The revolving joint (270) containing the elements of the spindle (200) that are subject to wear is compact and mounted on the free end (201) of the spindle (200) itself, that is, on the opposite end (201) with respect to said fixing or connection means (111) suited to connect it to the drilling head (10), so that it can be easily disassembled to carry out maintenance and/or replacement operations.

It is also possible to observe the position of the locking valve (260), which is diametrically external with respect to said actuators (240), so that it can be immediately accessed, too, when it is necessary to carry out maintenance operations. For greater graphic clarity, instead, the ducts (251, 252) that place the revolving joint (270) in communication with the locking valve (260) are not shown.

FIG. 8 shows a side view of the new spindle (200), with a partial sectional view showing a fluid accumulator (300).

FIG. 9 shows an axial three-dimensional sectional view of the spindle (200), in which it is possible to observe two accumulators (300) arranged circumferentially. The new spindle (200), in fact, comprises one or more accumulators (300), each comprising a tank inside which there is an expansion tank filled with a compressible fluid, for example nitrogen, at a specific starting pressure. The tank is in hydraulic communication with said at least one actuator (240), in such a way that when said hydraulic circuit (250) is pressurized at the clamping pressure, said tank is pressurized, too, and serves as a fluid compensator in case of leakages that would lead to a pressure loss. Thanks, instead, to the presence of the accumulators (300), the pressure exerted by the fluid on the actuator (240) remains unchanged, thus guaranteeing the clamping of the jaws.

Therefore, with reference to the above description and the attached drawings, the following claims are made.

The invention claimed is:

1. A spindle for a drilling head, having a substantially tubular or annular shape, and a clearance arranged to be coaxial with a drilling axis, comprising:

gripping members or gripping jaws configured to grip a drilling rod;

an actuator for selectively opening and closing said gripping members or jaws, wherein said actuator rotates around said drilling axis integrally with said gripping members or jaws, so that there is no bearing between said actuator and said gripping members or jaws;

a rotating part, comprising a flange configured to connect said rotating part to rotating components of the drilling head, said gripping members or jaws, and said actuator; and a revolving joint comprising a rotary annular element and a collar mounted on said rotary element, wherein the rotary annular element is integral with said rotating part, said collar comprising a constraint configured to prevent a rotation of said collar with respect to said drilling axis, wherein said revolving joint is in fluid communication with said actuator through a hydraulic circuit that is in fluid communication with the actuator and a locking valve, wherein the hydraulic circuit is configured to rotate integrally with said actuator, and wherein said revolving joint is mounted on a free end of said spindle, on an opposite end with respect to said flange configured to connect said revolving joint to the rotating components of the drilling head.

2. The spindle according to claim 1, wherein said locking valve is mounted in a radially outward position with respect to said actuator.

3. The spindle according to claim 1, further comprising one or more mechanical elements mounted between said collar and said rotary annular element to allow an idle rotation of said rotating part of the spindle with respect to said collar of the revolving joint.

4. The spindle according to claim 3, wherein said collar of said revolving joint comprises a first supply point for introduction of a fluid into a first delivery duct of the hydraulic circuit fluidically coupled to the actuator through said rotary annular element, and wherein said first delivery duct conveys the fluid through said locking valve to maintain pressure inside the at least one actuator to allow for radially inwardly extending said actuator.

5. The spindle according to claim 4, wherein said collar of said revolving joint comprises a second supply point for introduction of the fluid into a second delivery duct of the hydraulic circuit of the actuator through said rotary annular element, and wherein said second delivery duct conveys the fluid through said locking valve in such a way as to release the fluid and feed a return circuit fluidically coupled to said actuator where said actuator is a double-acting actuator.

6. The spindle according to claim 5, wherein said locking valve is configured in such a way that said locking valve selectively opens at a first pressure value corresponding to a chamber of said actuator, and selectively closes at a second pressure value corresponding to the chamber of said actuator.

7. The spindle according to claim 3, wherein said revolving joint comprises a cooling circuit, said cooling circuit comprising a channel which is obtained within said collar and in which a fluid suited to cool rotating parts and said one or more mechanical elements circulates.

8. The spindle according to claim 1, wherein said gripping members or jaws comprises inserts arranged circumferentially around said drilling axis and configured to move away from and towards the drilling axis in order to open or close on said drilling rod, wherein each of said inserts comprises an inclined part with wedges sliding axially thereon, and wherein the actuator acts on said wedges.

9. The spindle according to claim 1, wherein said actuator comprises at least one extendable cylinder or two or more independent hydraulic jacks distributed circumferentially around said drilling axis or another device configured to be extended in an axial direction, parallel to said drilling axis.

* * * * *